US009045692B2

(12) United States Patent
Lumley

(10) Patent No.: US 9,045,692 B2
(45) Date of Patent: Jun. 2, 2015

(54) LINEAR SHAPED CHARGE

(75) Inventor: Andrew Lumley, Alston (GB)

(73) Assignee: JET PHYSICS LIMITED, Cumbria (GB)

( * ) Notice: Subject to any disclaimer, the term of this patent is extended or adjusted under 35 U.S.C. 154(b) by 0 days.

(21) Appl. No.: 13/552,308

(22) Filed: Jul. 18, 2012

(65) Prior Publication Data

US 2013/0014662 A1 Jan. 17, 2013

Related U.S. Application Data

(63) Continuation of application No. PCT/GB2011/000062, filed on Jan. 18, 2011.

(30) Foreign Application Priority Data

Jan. 18, 2010 (GB) ..... 1000850.6

(51) Int. Cl.
*F42B 1/028* (2006.01)
*C10B 49/10* (2006.01)

(52) U.S. Cl.
CPC ..... *C10B 49/10* (2013.01); *F42B 1/028* (2013.01); *C10J 2300/0933* (2013.01)

(58) Field of Classification Search
USPC ..... 102/476, 306, 307, 308, 309, 310, 331
See application file for complete search history.

(56) References Cited

U.S. PATENT DOCUMENTS 4,151,798 A 5/1979 Ridgeway
4,693,181 A * 9/1987 Dadley et al. ..... 102/307
4,905,601 A * 3/1990 Gabriel et al. ..... 102/307
6,393,991 B1 * 5/2002 Funston et al. ..... 102/476
6,609,464 B1 * 8/2003 Hilden et al. ..... 102/306
7,086,629 B2 * 8/2006 Hilden et al. ..... 244/122 AF
7,536,956 B2 * 5/2009 Sammons et al. ..... 102/476

(Continued)

FOREIGN PATENT DOCUMENTS

EP 263204 A1 * 4/1988 ..... F42B 1/02
EP 1 164 348 A2 12/2001
FR 2 333 764 A1 7/1977
GB 1 237 392 A 6/1971
GB 2165868 A 4/1986

(Continued)

OTHER PUBLICATIONS

International Search Report for PCT/GB2011/000062 Dated May 4, 2011.

(Continued)

*Primary Examiner* — Benjamin P Lee
(74) *Attorney, Agent, or Firm* — EIP US LLP

(57) ABSTRACT

One or more aspects of the present invention relate to a linear shaped charge comprising an explosive element, a liner, a face for application to a target object and a space between the liner and the face, the liner being arranged for projection through the space, towards the face, when the explosive element is detonated, and the explosive element and the liner having a V-shaped cross section, the liner lying in a groove of the V-shaped cross section of the explosive element, the liner having a length L of a side furthest from the face and the liner having a thickness T taken perpendicular to said length L, wherein an angle α of an apex of the liner nearest the face is 101.5 to 106.5 degrees, and a stand-off distance SD between the face and a point of the liner nearest the face is 0.99 S to 1.21 S, S being a distance, parallel the stand-off distance SD, between the point of the liner nearest the face and the apex of the liner nearest the face.

20 Claims, 1 Drawing Sheet

(56) References Cited

U.S. PATENT DOCUMENTS

| | | | | |
|---|---|---|---|---|
| 7,811,354 | B2 * | 10/2010 | Leidel et al. | 75/246 |
| 2005/0241522 | A1 | 11/2005 | Stawovy | |
| 2006/0201373 | A1 * | 9/2006 | Sammons et al. | 102/476 |
| 2008/0034951 | A1 * | 2/2008 | Evans et al. | 89/1.15 |
| 2009/0050321 | A1 * | 2/2009 | Rhodes et al. | 166/297 |
| 2009/0078144 | A1 * | 3/2009 | Behrmann et al. | 102/307 |
| 2010/0275800 | A1 * | 11/2010 | Stawovy | 102/306 |
| 2012/0247358 | A1 * | 10/2012 | Daoud et al. | 102/307 |
| 2013/0014663 | A1 | 1/2013 | Lumley | |

FOREIGN PATENT DOCUMENTS

| | | | | | |
|---|---|---|---|---|---|
| GB | 2179664 | A | | 3/1987 | |
| GB | 2295664 | A | * | 6/1996 | F42B 1/032 |
| WO | WO 2004048880 | A1 | * | 6/2004 | F42B 1/032 |

OTHER PUBLICATIONS

Written Opinion for PCT/GB2011/000062 Dated May 4, 2011.
GB Search Report for May 14, 2010 (GB1000850.6).
"Advanced Cutting Explosive" published by Ensign-Bickford Aerospace & Defense Company, 2003.

* cited by examiner

LINEAR SHAPED CHARGE

CROSS-REFERENCE TO RELATED APPLICATIONS

This application is a Continuation of PCT/GB2011/000062, filed Jan. 18, 2011 which is an international application claiming priority to Great Britain App. No. 1000850.6, filed Jan. 18, 2010. The entire contents of which are incorporated herein by reference in their entirety.

FIELD OF THE INVENTION

The present invention relates to a linear shaped charge.

BACKGROUND OF THE INVENTION

A linear cutting charge is an explosive device for cutting a target object. A type of linear cutting charge is termed a linear shaped charge. Linear shaped charges are known from the prior art, for example from U.S. Pat. No. 4,693,181, and the product commercially known as "Blade"® generic charge, demolition, linear, cutting/flexible, lightweight (CDLC/FL). In use, a linear shaped charge is applied to a target object for cutting. Upon detonation of an explosive element in the charge, a metal liner forms a metal slug which is projected as a cutting jet towards the target object. The cutting jet is linear, along a longitudinal axis of the charge, and therefore cuts the target object along a line defined by a configuration of the charge when applied to the target object. This may be a curved linear configuration. The shape and depth of the cut may be finely controlled, by selecting appropriate dimensions and explosive loadings in the charge. Accordingly, linear shaped charges have many and varied applications, both civil and military, where a clean and controlled cut is required. Given the high cutting power, linear shaped charges may be used to cut concrete or metallic structures, for example when breaching walls or demolishing building structures. The precision of the line and depth of the cut allows for delicate cutting operations, for example cutting of a bomb casing. Users of linear shaped charges, including oil field downhole service engineers, demolition engineers, breachers and explosive ordinance disposal specialists observe that a frequently encountered problem is reduced cutting action of a linear shaped charge, caused by separation of the charge from a target, brought about by deployment and attachment difficulties to problematic target surfaces, such as a wet or complex surface. Consequently, cutting effectiveness by the jet may be decreased, reducing a depth of target penetration, giving an increased cut width and causing spall fracture. Further, the unreliability of cutting of prior art charges may be unpredictable and dangerous.

It is an object of present invention to overcome these disadvantages.

SUMMARY OF THE INVENTION

In accordance with the present invention, there is provided a linear shaped charge comprising an explosive element, a liner, a face for application to a target object and a space between the liner and the face, the liner being arranged for projection through the space, towards the face, when the explosive element is detonated, and the explosive element and the liner having a V-shaped cross section, the liner lying in a groove of the V-shaped cross section of the explosive element, the liner having a length L of a side furthest from the face and the liner having a thickness T taken perpendicular to said length L, wherein an angle $\alpha$ of an apex of the liner nearest the face is 101.5 to 106.5 degrees, and a stand-off distance SD between the face and a point of the liner nearest the face is 0.99 S to 1.21 S, S being a distance, parallel the stand-off distance SD, between the point of the liner nearest the face and the apex of the liner nearest the face.

The geometry of the linear cutting charge of the present invention provides an efficient and effective cutting jet for cutting target objects with numerous and complex configurations. Even if complications occur when applying or attaching the charge to the target, for example if at least part of the charge detaches from the target object before the explosive element is detonated, the charge of the present invention is arranged to accommodate these. Thus the charge of the invention is effective and reliable in numerous practical applications.

The insight of the inventor lies in realising that surface irregularities of a target object, leading to non-optimum application of the charge to the target object, causes elongation and thinning of the cutting jet. In prior art situations the cutting jet may break up, losing its homogeneity; accordingly, the quality of the target cut suffers, often leading to a failed cut and a target wound with reduced depth of penetration, increased cut width and spall fracture.

The linear shaped charge of the present invention delivers a cutting jet that is optimally thin and long for precision cutting. Upon detonation of the charge, the geometry of the present invention, including the stand-off distance SD of 0.99 S to 1.21 S, and the apex angle of 101.5 to 106.5 degrees, provides that the cutting jet is created near to the surface of the target, so the jet has less distance to travel to do cutting work and thus less opportunity for instability or break up; in prior art charges, the jet forms nearer the liner and further from the target object. Accordingly, the present invention requires less stand-off distance than prior art charges. This has been realised by the inventor by devising a value of 0.99 to 1.21 for the ratio of stand-off distance to distance S, i.e. SD:S, in combination with the apex angle between 101.5 and 106.5. Moreover, the geometry of the linear shaped charge of the invention creates a jet which is more continuously delivered once the explosive element is detonated. In other words, the jet is created for a longer duration, meaning it can travel further and continue to cut the target for longer. Thus, the jet can exist over greater distances between the liner and the target object than the stand-off distance SD, if necessary, and still deliver hydrodynamic cutting. Should the charge be unavoidably separated from the target in deployment or attachment and an extended standoff introduced, the charge of the invention will deliver a jet that will span the gap from the face to the target object and deliver the required hydrodynamic cutting action.

Further, defining the apex angle and stand-off distance SD in accordance with the invention, the linear shaped charge design is scalable, for making a linear shaped charge with a suitable explosive load for a desired purpose, with advantages of the invention described above.

In some embodiments of the present invention, the apex angle $\alpha$ is 102 to 106 degrees, 102.5 to 105.5 degrees or 103 to 105 degrees. In further embodiments the stand-off distance SD is 1.045 S to 1.155 S, 1.075 S to 1.125 S, or 1.1 S. The linear shaped charge may be scaled in accordance with these apex angle and stand-off distance parameters, for obtaining charges with advantages of the invention and with a desired explosive load.

In other embodiments of the invention, S may be 0.9 to 1.1 milli-meters, 0.95 to 1.05 milli-meters, 0.972 to 1.02 milli-meters or 1 milli-meter. The distance SD may be 0.99 to 1.21 milli-meters, 1.045 to 1.155 milli-meters, 1.075 to 1.125 milli-meters, or 1.1 milli-meters.

Further, in other embodiments of the invention, S may be 2.4 to 33.9, 2.4 to 3.0, 2.7, 3.8 to 4.7, 4.3, 7.3 to 9.0, 8.2, 9.6 to 11.8, 10.7, 13.3 to 16.3, 14.8, 21.5 to 26.3, 23.9, 24.8 to 30.3, 27.6, 27.8 to 33.9, or 30.8 milli-meters. In other embodiments, the distance SD may be 2.7 to 37.3, 2.7 to 3.3, 3.0, 4.2 to 5.2, 4.7, 8.1 to 9.9, 9.0, 10.6 to 12.9, 11.8, 14.6 to 17.9, 16.3, 23.7 to 28.9, 26.3, 27.3 to 33.4, 30.3, 30.5 to 37.3 or 33.9 milli-meters.

A linear shaped charge designed in accordance with these parameters still allows the explosive load of the charge to be selected in accordance with the intended cutting task.

In yet further embodiments, a length L of a side of the V-shaped liner furthest from the face is 8.1 T to 9.9 T milli-meters, 8.55 T to 9.45 T milli-meters, or 9 T milli-meters. Further, a thickness E of the explosive element, taken perpendicular a length of a side of the V-shaped explosive element, may be 4.5 T to 5.5 T milli-meters, 4.75 T to 5.25 T milli-meters, or 5 T milli-meters. Moreover, the thickness T may be 0.9 to 1.1 milli-meters, 0.95 to 1.05 milli-meters or 1 milli-meter. In other embodiments, the thickness T may be 0.4 to 6.1, 0.4 to 0.5, 0.5, 0.7 to 0.9, 0.8, 1.3 to 1.6, 1.5, 1.7 to 2.1, 1.9, 2.4 to 2.9, 2.6, 3.8 to 4.7, 4.3, 4.4 to 5.4, 4.9, 5.0 to 6.1 or 5.5 milli-meters. Linear shaped charges designed in accordance with a length L, thickness E and thickness T dimensions selected from those above exhibit excellent cutting efficiency. Selecting at least one of the length L, thickness E and thickness T dimensions in accordance with the above, for a linear shaped charge having an apex angle and stand-off distance SD according to the invention, yet further improves the quality of the jet, meaning it is more homogenous and continuous, and more accommodating of irregular target surfaces and a distance between the liner and the target object which may be greater than the stand-off distance SD.

In some embodiments of the present embodiment, the thickness E is 5 T, the length L is 9 T and the thickness T is 1 T. By selecting a geometry of the linear shaped charge in accordance with this relationship, a cutting jet may be provided for reliably cutting numerous different target objects in a variety of practical applications, due to the homogeneous jet formed and the formation of the jet close to the target object. The inventor has devised that this relationship, in combination with the apex angle and stand-off distance of the invention, yields this effective cutting jet. When designing a linear shaped charge, a desired explosive load of the charge may therefore be selected, and an optimised cutting jet capability provided by applying the relationship of E=5 T, L=9 T and T=1 T, in combination with an apex angle $\alpha$ and stand-off distance SD according to the invention; in such charges the stand-off distance SD may be 1.1 S.

In other embodiments of the present invention, the apex angle $\alpha$ is 103 degrees and the stand-off distance SD is 9.0, 11.8 or 16.3 milli-meters, or alternatively may be 1.1 milli-meters. In further embodiments, the length L is 9 milli-meters, the thickness E is 5 milli-meters, and the thickness T is 1 milli-meter. In further embodiments, the stand-off distance is 1.1 S, and with the stand-off distance being 9.0, 11.8 or 16.3 milli-meters, the length L is 13.1, 17.2 or 23.8 milli-meters, respectively, the thickness E is 7.3, 9.5 or 13.2 milli-meters, respectively, and the thickness T is 1.5, 1.9 or 2.6 milli-meters, respectively. A linear shaped charge with such dimensions is one example of an embodiment with geometry for delivering a cutting jet optimised for reliable target cutting in many common practical applications. Examples of an explosive load of the explosive element which performs well with such embodiments include, with the stand-off distance SD being 9.0, 11.8 or 16.3 milli-meters, an explosive load of substantially 0.35, 0.6 or 1.15 kg $m^{-1}$, respectively. The term "substantially" herein refers to a mean explosive load of the explosive element; for example an explosive load of 0.35 kg $m^{-1}$ is a mean explosive load of 0.35 kg $m^{-1}$.

In alternative embodiments, the apex angle $\alpha$ is 105 degrees and the stand-off distance SD is 3.0 or 4.7 milli-meters, or may alternatively be 1.1 milli-meters. Further, the length L may be 9 milli-meters, the thickness E is 5 milli-meters, and the thickness T is 1 milli-meter. In further embodiments, the stand-off distance is 1.1 S, and with the stand-off distance being 3.0 or 4.7 milli-meters, the length L is 4.4 or 7.0 milli-meters, respectively, the thickness E is 2.5 or 3.9 milli-meters, respectively, and the thickness T is 0.5 or 0.8 milli-meters, respectively. A linear shaped charge with such dimensions is another example of an embodiment with geometry for delivering a cutting jet for reliable target cutting in many common practical applications. Examples of an explosive load of the explosive element which performs well with such embodiments include, with the stand-off distance SD being 3.0 or 4.7 milli-meters, an explosive load of substantially 0.04 or 0.1 kg $m^{-1}$, respectively. The term "substantially" herein refers to a mean explosive load of the explosive element, as explained above.

The stand-off distance may be perpendicular a plane of the face, and the distance S is perpendicular the plane of the face.

In further embodiments of the present invention, a casing surrounds at least part of the explosive element. In other embodiments, the casing is arranged to determine the stand-off distance SD, the casing having at least one part for application to the target object. In yet further embodiments, at least part of the space is filled with a filling material. A linear shaped charge according to claim 17, wherein the filling material is arranged to fill substantially all of the space; the term substantially in this context means that more than 50% of the space is filled by the filling material. In alternative embodiments, the casing and the filling material are integrally formed.

Further features of the invention will become apparent from the following description of embodiments of the invention, given by way of example only, which is made with reference to the accompanying drawings.

DETAILED DESCRIPTION OF THE INVENTION

Figure 1:
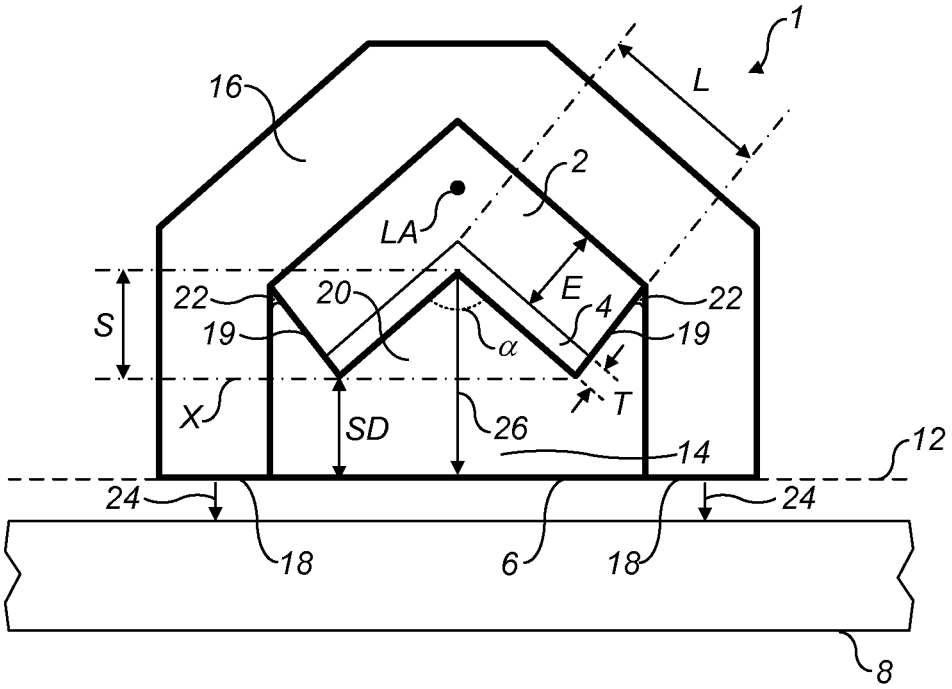
FIG. 1 shows schematically a cross section of an embodiment of the present invention.
Figure 2:
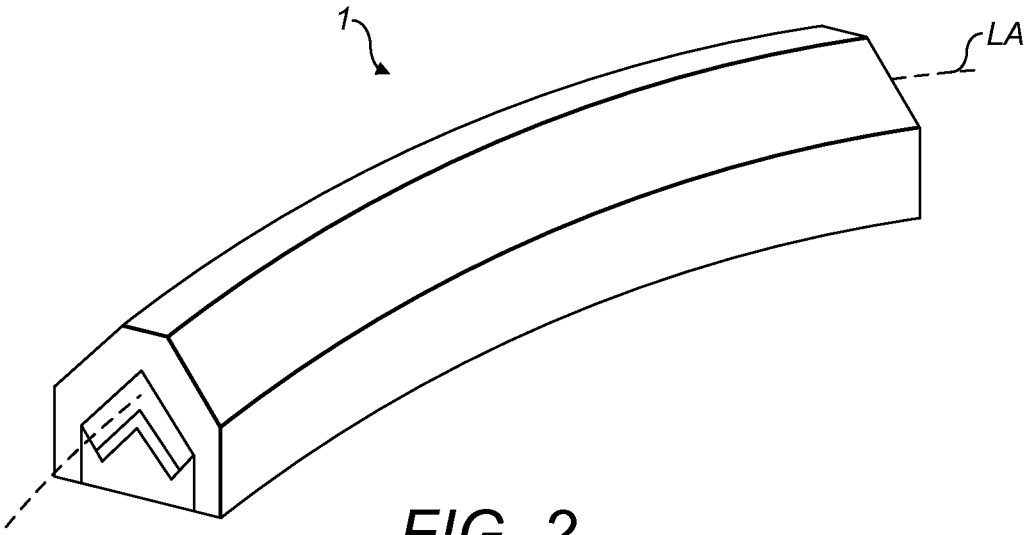
FIG. 2 shows schematically a perspective view of an embodiment of the present invention.

FIG. 1 shows schematically a cross section of a linear shaped charge 1 according to an embodiment of the present invention. FIG. 2 shows schematically a perspective view of the linear shaped charge 1 of this embodiment.

Referring to FIG. 1, the linear shaped charge comprises an explosive element 2, a liner 4, and a face 6 for application to a target object 8. The explosive element and the liner have a V-shaped cross section, taken in a plane perpendicular a longitudinal axis LA of the charge 1, as illustrated in FIG. 1. The term V-shape includes forms where the two sides of the V, either side of the apex, are equal, or unequal, in length; the sides may be equal. The liner lies in a groove of the V shaped cross section of the explosive element. The explosive element and the liner are formed of materials which adhere to each other upon contact, without requiring a separate adhesive. The face 6 is planar, defining a target plane 12. There is a space 14 between the liner 4 and the face 6. The liner is arranged for projection through the space, towards the face, when the explosive element is detonated.

In this embodiment, a casing 16 surrounds at least part of the explosive element 2. The casing 16 provides structural support to the charge 1, including to the explosive element and the liner during bending of the charge. The casing 16 also protects the explosive element and the liner from environmental factors such as rain, water vapour, and from being damaged if dropped or knocked.

The casing has a V-shaped surface which receives the explosive element 2 on a side opposite the side of the explosive element adhered to the liner 4. The casing 16 is arranged to determine a distance between the liner and the face, for example in this embodiment the casing 16 extends beyond a point of the liner nearest the face to define two longitudinal surfaces 18, parallel the longitudinal axis LA, lying in the plane 12 of the face 6. Thus, the casing has at least one part for application to the target object.

The extent of the casing 16 beyond the liner in this embodiment defines a stand-off distance SD. The stand-off distance SD is a distance between a point of the liner nearest the face 6 and the plane 12 of the face 6. The stand-off distance SD may be perpendicular to the plane of the face. The stand-off distance SD is within the range 0.99 S to 1.21 S. S is a distance between the point of the liner nearest the face and the apex of the liner nearest the face. The distance S is parallel the stand-off distance SD and may be perpendicular to the plane of the face 6 when the parts of the casing extending beyond the liner are equal in length. The stand-off distance SD may be taken anywhere between the face and a line X joining the two points of the liner nearest the face, and is most correctly taken between the face and a centre point of the line X, the centre point being illustrated in FIG. 1 as the intersection between arrow 26 and line X. It is envisaged in other embodiments that the parts of the casing extending beyond the liner may not be equal in length, thus changing the angle of the face with respect to the liner orientation. For such embodiments the most correct definition of the stand-off distance SD described above should be taken as the definition of the stand-off distance SD in accordance with present invention.

The liner has a length L of a side furthest from the face 6. Further, the liner has a thickness T which is taken perpendicular the length L. The liner may have a uniform thickness T on either side of the apex. Also, the explosive element has a thickness E which is taken perpendicular a length of a side of the V-shaped explosive element. The explosive element may have a uniform thickness E on either side of the apex. An angle $\alpha$ of an apex of the liner nearest the face is within the range 101.5 to 106.5 degrees. As illustrated, the liner 4 has longitudinal sides 19 which connect a side of the liner adjacent the casing and a side of the liner adjacent the liner. These sides 19 may lie perpendicularly to the side adjacent the casing and the side adjacent the liner they connect. Thus, the sides 19 may lie in contact with the filling material, depending on the volume of filling material in the space 14. In at least some embodiments, this arrangement of the sides 19 may contribute to performance of the cutting jet.

In embodiments of the present invention, the apex angle $\alpha$ may be 102 to 106 degrees, 102.5 to 105.5 degrees or 103 to 105 degrees. In further embodiments the stand-off distance SD may be 1.045 S to 1.155 S, 1.075 S to 1.125 S, or 1.1 S. In yet further embodiments, S may be 0.9 to 1.1 milli-meters, 0.95 to 1.05 milli-meters, 0.972 to 1.02 milli-meters or 1 milli-meter. Accordingly, the distance SD may be 0.99 to 1.21 milli-meters, 1.045 to 1.155 milli-meters, 1.075 to 1.125 milli-meters, or 1.1 milli-meters.

In further embodiments of the present invention, S may be 2.4 to 33.9, 2.4 to 3.0, 2.7, 3.8 to 4.7, 4.3, 7.3 to 9.0, 8.2, 9.6 to 11.8, 10.7, 13.3 to 16.3, 14.8, 21.5 to 26.3, 23.9, 24.8 to 30.3, 27.6, 27.8 to 33.9, or 30.8 milli-meters. In yet further embodiments, the distance SD may be 2.7 to 37.3, 2.7 to 3.3, 3.0, 4.2 to 5.2, 4.7, 8.1 to 9.9, 9.0, 10.6 to 12.9, 11.8, 14.6 to 17.9, 16.3, 23.7 to 28.9, 26.3, 27.3 to 33.4, 30.3, 30.5 to 37.3 or 33.9 milli-meters.

In yet further still embodiments, the length L may be 8.1 T to 9.9 T milli-meters, 8.55 T to 9.45 T milli-meters, or 9 T milli-meters. Further, the thickness E may be 4.5 T to 5.5 T milli-meters, 4.75 T to 5.25 T milli-meters, or 5 T milli-meters. Moreover, the thickness T may be 0.9 to 1.1 milli-meters, 0.95 to 1.05 milli-meters or 1 milli-meter. In other embodiments, the thickness T may be 0.4 to 6.1, 0.4 to 0.5, 0.5, 0.7 to 0.9, 0.8, 1.3 to 1.6, 1.5, 1.7 to 2.1, 1.9, 2.4 to 2.9, 2.6, 3.8 to 4.7, 4.3, 4.4 to 5.4, 4.9, 5.0 to 6.1 or 5.5 milli-meters.

Table 1 indicates the apex angle $\alpha$, length L, thickness E, thickness T, distance S and stand-off distance SD parameters for some embodiments, labelled A to R, of the present invention. The data for these parameters is given with an accuracy to one decimal place; therefore the actual value may fall within a range of +/−0.05 milli-meters of the value given in the table. Explosive load data is given also, these being substantial explosive loads as defined previously. For the examples listed in the table, the stand-off distance is 1.1 S and the thickness E, the length L and the thickness T are related in the ratio 5:9:1.

TABLE 1

| Embodiment | Standoff Distance SD/mm | Distance S/mm | Explosive Thickness E/mm | Length L/mm | Thickness T/mm | Apex Angle $\alpha$/degrees | Explosive Load Kg/m |
|---|---|---|---|---|---|---|---|
| A | 3.0 | 2.7 | 2.5 | 4.4 | 0.5 | 105 | 0.04 |
| B | 4.7 | 4.3 | 3.9 | 7.0 | 0.8 | 105 | 0.10 |
| C | 9.0 | 8.2 | 7.3 | 13.1 | 1.5 | 103 | 0.35 |
| D | 11.8 | 10.7 | 9.5 | 17.2 | 1.9 | 103 | 0.60 |
| E | 16.3 | 14.8 | 13.2 | 23.8 | 2.6 | 103 | 1.15 |
| F | 21.5 | 19.5 | 17.4 | 31.3 | 3.5 | 103 | 2.00 |
| G | 22.8 | 20.7 | 18.5 | 33.2 | 3.7 | 103 | 2.25 |
| H | 24.0 | 21.8 | 19.5 | 35.0 | 3.9 | 103 | 2.50 |
| I | 25.2 | 22.9 | 20.4 | 36.7 | 4.1 | 103 | 2.75 |
| J | 26.3 | 23.9 | 21.3 | 38.4 | 4.3 | 103 | 3.00 |
| K | 27.4 | 24.9 | 22.2 | 39.9 | 4.4 | 103 | 3.25 |
| L | 28.4 | 25.8 | 23.0 | 41.5 | 4.6 | 103 | 3.50 |
| M | 29.4 | 26.7 | 23.8 | 42.9 | 4.8 | 103 | 3.75 |

TABLE 1-continued

| Embodiment | Standoff Distance SD/mm | Distance S/mm | Explosive Thickness E/mm | Length L/mm | Thickness T/mm | Apex Angle α/degrees | Explosive Load Kg/m |
|---|---|---|---|---|---|---|---|
| N | 30.3 | 27.6 | 24.6 | 44.3 | 4.9 | 103 | 4.00 |
| O | 31.3 | 28.4 | 25.4 | 45.7 | 5.1 | 103 | 4.25 |
| P | 32.2 | 29.3 | 26.1 | 47.0 | 5.2 | 103 | 4.50 |
| Q | 33.1 | 30.1 | 26.8 | 48.3 | 5.4 | 103 | 4.75 |
| R | 33.9 | 30.8 | 27.5 | 49.5 | 5.5 | 103 | 5.00 |

In view of manufacturing tolerances, linear shaped charges manufactured according to the specifications of table 1 may have different values from those in Table 1 by up to +/−10%, with the exception of the apex angle which may have a deviation of +/−1% from the value given in Table 1, and within the range of the present invention of 101.5 to 106.5 degrees, and with the exception of the explosive load which may have a deviation of +/−20% of the value given in Table 1. Table 2 below therefore lists the same embodiments A to E and J, N and R, but with a minimum and a maximum tolerance value for each parameter according to manufacturing tolerances. The minimum value and maximum value for embodiment A is labelled Amin and Amax, respectively, for example. The minimum value is 10% below the corresponding value in Table 1 and the maximum value is 10% above the corresponding value in Table 1 for all values except the apex angle which has a deviation of +/−1% for the minimum and maximum values, and the explosive load having a deviation of +/−20% for the minimum and maximum values. The stand-off distance may therefore range from 0.99 S to 1.21 S.

Embodiments J, N and R are given in Table 2 as examples of embodiments F to R. It is envisaged that the corresponding deviations described above apply also for the embodiments F to R not listed explicitly in Table 2.

TABLE 2

| Embodiment | Standoff Distance SD/mm | Distance S/mm | Explosive Thickness E/mm | Length L/mm | Thickness T/mm | Apex Angle α/degrees | Explosive Load/ Kg/m |
|---|---|---|---|---|---|---|---|
| A min | 2.7 | 2.4 | 2.2 | 4.0 | 0.4 | 104.0 | 0.03 |
| A max | 3.3 | 3.0 | 2.7 | 4.9 | 0.5 | 106.1 | 0.05 |
| B min | 4.2 | 3.8 | 3.5 | 6.3 | 0.7 | 104.0 | 0.08 |
| B max | 5.2 | 4.7 | 4.3 | 7.7 | 0.9 | 106.1 | 0.12 |
| C min | 8.1 | 7.3 | 6.6 | 11.8 | 1.3 | 102.0 | 0.28 |
| C max | 9.9 | 9.0 | 8.0 | 14.4 | 1.6 | 104.0 | 0.42 |
| D min | 10.6 | 9.6 | 8.6 | 15.4 | 1.7 | 102.0 | 0.48 |
| D max | 12.9 | 11.8 | 10.5 | 18.9 | 2.1 | 104.0 | 0.72 |
| E min | 14.6 | 13.3 | 11.9 | 21.4 | 2.4 | 102.0 | 0.92 |
| E max | 17.9 | 16.3 | 14.5 | 26.1 | 2.9 | 104.0 | 1.38 |
| J min | 23.7 | 21.5 | 19.2 | 34.5 | 3.8 | 102.0 | 2.40 |
| J max | 28.9 | 26.3 | 23.5 | 42.2 | 4.7 | 104.0 | 3.60 |
| N min | 27.3 | 24.8 | 22.2 | 39.9 | 4.4 | 102.0 | 3.20 |
| N max | 33.4 | 30.3 | 27.1 | 48.7 | 5.4 | 104.0 | 4.80 |
| R min | 30.5 | 27.8 | 24.8 | 44.6 | 5.0 | 102.0 | 4.00 |
| R max | 37.3 | 33.9 | 30.3 | 54.5 | 6.1 | 104.0 | 6.00 |

It is to be appreciated that, in view of manufacturing tolerances, each parameter having a possible deviation of +/−10% may not necessarily vary from the specified value in Table 1 by +/−10%. Each value may vary by +/−7.5%, 0.5%, 0.25%, 0.15%, 0.1%, or 0.05%, for example. Further, for the apex angle, the value of Table 1 may deviate by for example +/−0.75%, 0.5% or 0.25%, and for the explosive load the value of Table 1 may deviate by for example +/−17.5%, 15%, 12.5%, 10%, 7.5%, 5% or 2.5%.

In a further embodiment of the present invention, the apex angle α is 103 degrees and the stand-off distance SD is 1.1 milli-meters. In further embodiments, the length L may be 9 milli-meters, the thickness E may be 5 milli-meters, and the thickness T may be 1 milli-meter. An explosive load of the explosive element in such embodiments may be substantially 0.35, 0.6 or 1.15 kg $m^{-1}$. In an alternative embodiment, the apex angle α is 105 degrees and the stand-off distance SD is 1.1 milli-meters. Further, the length L may be 9 milli-meters, the thickness E may be 5 milli-meters, and the thickness T may be 1 milli-meter. An explosive load of the explosive element in such embodiments may be substantially 0.04 or 0.1 kg $m^{-1}$.

The shape and volume of the space 14 is determined by the geometry of the explosive element 2, the liner 4 and the casing 16. A filling material 20 may fill substantially all of the space 14. The term substantially in this context means that more than 50% of the space is filled by the filling material. In the present embodiment all of the space is filled with the filling material, except for voids 22 formed to avoid feathering of edges of the filling material when being shaped. In other embodiments, greater than 75%, or greater than 90% of the space may be filled by the filling material. In another embodiment, 100% of the space is filled by the filling material. In alternative embodiments, at least part of the space may be filled with the filling material, for example less than 50% of the space. The filling material has a density of between 15 kg $m^{-3}$ and 60 kg $m^{-3}$, 25 to 60 kg $m^{-3}$, 35 to 60 kg $m^{-3}$, 45 to 60 kg $m^{-3}$, 50 to 60 kg $m^{-3}$ or 55 to 60 kg $m^{-3}$; greater than 60 kg $m^{-3}$ may obstruct the jet, thus decreasing the penetration of the cut into the target object. In other embodiments, the space may be empty; i.e. not filled.

In the present embodiment, the filling material 20 is fixed to parts of the casing 16 adjacent the filling material 20 with an adhesive; in alternative embodiments, the filling material and the casing may be integrally formed. In such embodiments, the casing and filling material press the explosive element against the casing and the liner against the filling material with sufficient pressure to fix the explosive element and liner in place in the charge 1. In alternative embodiments, with or without the filling material, the explosive element may be fixed to the casing with adhesive.

The filling material may not extend beyond the plane 12 of the face 6. In some embodiments, the filling material may have a face lying in the plane 12 of the face 6 of the charge, for application to the target object 8. The face 6 may comprise an adhesive layer (not shown) for adhering the charge 1 to the target object 8.

In use, the face 6 of the charge is applied to the target object 8, as indicated by arrows 24. The charge may be adhered or otherwise held in position on the target object. The charge 1 may be flexible along the longitudinal axis LA, by choosing appropriate materials of the component parts of the charge. The flexibility means the charge is not rigid and may be changed from a first configuration to a second configuration, so the charge may be applied in a curved configuration on the target object, for example with the face 6 of the charge on a planar surface of the target object, or with the face 6 following contours of a non-planar surface of the target object.

Once the charge 1 is applied to the target object, the explosive element 2 is detonated, using for example an electrical detonator. Upon detonation, the liner 4 is projected towards the target object 8 as a jet 26 originating from the apex of the liner 4. The jet 26 penetrates the target object along the length of the charge, thus cutting the target object 8.

The target object 8 illustrated in FIG. 1 is an example. A linear shaped charge according to the present invention may be used to cut many different objects, of various shapes with varying complexity, and formed of numerous different materials, organic and inorganic, for example metal, concrete, mineral, or plastic.

Examples of materials of components of a linear shaped charge described above in accordance with the invention will now be described.

The explosive element 2 comprises for example a mixture of 88% by weight of RDX (cyclotrimethylenetrinitramine), 8.4% by weight PIB (polyisobutylene), 2.4% by weight DEHS (2(Diethylhexyl)sebacate), and 1.2% by weight PTFE (polytetrafluoroethylene), the % by weight being a percentage of the weight of the explosive element. Alternatively, the explosive element may comprise SX2/Demex Plastic Explosive from BAE Systems, Glascoed, USK, Monmouthshire NP15 1XL, UK, or Primasheet 2000 Plastic Explosive from Ensign-Bickford Aerospace & Defense Company, Simsbury, Conn. 06070 USA.

The liner may comprise a mixture of 85 wt % of 300 mesh copper particles, 5.6 wt % polyisobutylene, 2.4 wt % 2(diethylhexyl)sebacate) (DEHS) and 7.0 wt % polytetrafluoroethylene (PTFE) as is known in the art. The term wt % means weight percentage of the total weight of the mixture.

Alternatively, the liner may comprise a material comprising copper particles dispersed in a polymer matrix. Alternatively, the particles may comprise at least one metal selected from the group consisting of: copper (Cu), tungsten (W), molybdenum (Mo), aluminium (Al), uranium (U), tantalum (Ta), lead (Pb), tin (Sn), cadmium (Cd), cobalt (Co), magnesium (Mg), titanium (Ti), zinc (Zn), zirconium (Zr), beryllium (Be), nickel (Ni), silver (Ag), gold (Au), platinum (Pt), and/or an alloy thereof. The particles may be substantially spherical. The term substantially spherical means the average shape of the particles is spherical. The particles are packed in the polymer matrix with a density of at least 0.625, 0.650, 0.675, or 0.700 of the density of the Cu. The packing corresponds with the Kepler Conjecture on packing. The particles may be substantially uniformly dispersed in the polymer matrix, with neighbouring particles being separated from each other by polymer. Substantially uniformly means that a mean separation distance between neighbouring particles in a first volume, and in a different second volume of the material, are equal. The material has a density of greater than 5,000, 5,100, 5,200, 5,300, 5,400, 5,500, 5,600, 5,700, or substantially 5,800 kg $m^{-3}$. Substantially 5,800 kg $m^{-3}$ means the mean density of the material throughout its volume is 5,800 kg $m^{-3}$. The particles may comprise particles with different diameters, for example, specifically: 0.5 to 1 wt % particles with a diameter of 70 micro-meters; 4 to 5 wt % particles with a diameter of 60 micro-meters; 20 to 30 wt % particles with a diameter of 50 micro-meters; 25 to 35 wt % particles with a diameter of 40 micro-meters; 20 to 30 wt % particles with a diameter of 10 micro-meters; and less than 3 wt % particles with a diameter of less than 10 micro-meters. The term wt % used for the ranges of particle size refers to a percentage weight of the total mass of particles in the material. In an example where the particles are of copper and have the ranges of different diameters described above, the copper particles are 88 wt % of the total weight of the material. The copper particles are obtainable from ECKA Granulate GmbH & Co. KG, Frankenstraβe 12 D-90762 Furth, Germany.

The polymer matrix of the material comprises polyisobutylene (PIB) or polybutene (PB) which is 4.5 wt % of the total weight of the material. The PIB is for example Oppanol® B10, B12, B15 or B30 supplied by BASF, Ludwigshafen, OH 67063, Germany. The polymer matrix further comprises boron nitride, or a polytetrafluoroethylene dry lubricant, which is 4.5 wt % of the total weight of the material. Such a dry lubricant is obtainable as h-BN from Goodfellow Limited, Huntingdon, Cambridgeshire PE29 6WR or Fluon® FL1690 or FL1710 from AGC Chemicals Europe, Ltd, Thornton Cleveleys, Lancashire FY5 4QD, UK.

Further, the polymer matrix comprises cyanuric acid or melamine, or polytetrafluoroethylene filler (including environmentally friendly "E" grades) which is 1.5 wt % of the total weight of the material. Cyanuric acid and melamine are obtainable from Monsanto UK Limited, Cambridge CB1 0LD, UK and ICI Akzo Nobel Powder Coatings Ltd., Gateshead, Tyne & Wear NE10 0JY, UK. Polytetrafluoroethylene filler is obtainable as CD123, CD127 or CD141 from Asahi Glass AGC Chemicals Europe Limited, Thornton Cleveleys, Lancashire FY5 4QD, UK.

Di-2-ethylhexyl sebacate (dioctyl sebacate—DOS) or di-n-octyl phthalate (DOP) plasticizer/wet lubricant is also added, as 1.5 wt % of the total weight of the material. Either may be obtained from Brad-Chem Ltd, Moss Ind. Estate. Leigh, Lancashire WN7 3PT, UK. Vegetable and other synthetic oil lubricants of diester type can be substituted as a plasticizer.

The material of this embodiment may be made in accordance with one of the following two methods:

In the first method, which yields approximately 10 kg material, is a two-phase system is used consisting of an aqueous liquid phase and a second liquid phase which comprises an organic solvent that is insoluble in water carrying the polyisobutene binder. The polyisobutene binder is dissolved in a solvent of toluene to prepare a solution, which then is injected into the metal powder and filler and dry lubricant mix dispersed in water. A granular product is formed from the obtained mixture; this is then distilled to isolate the bulk polymer. This polymer may be calandered and slit to produce the required sectional dimensions for a liner of a linear shaped charge.

Specific process steps are now explained:

i) 8.80 kg of the copper particles with the different diameters described above and 0.60 kg filler and dry lubricant mixture (0.45kg h-BN, FL1690 or FL1710 dry lubricant and 0.15kg cyanuric acid, melamine, CD123, CD127 or CD141 dispersion filler) are put into a glass bead mill with stirrer and a capacity of approx. 20 liters.

ii) After stirring for 20 minutes at room temperature, the mix is deagglomerated and thoroughly wetted by the water. The suspension is then flushed out of the mill, separated from the glass beads and put into an agitator vessel.

iii) With moderate stirring, a solution of 0.45 kg of polyisobutene (BASF Oppanol B10, B12, B15 or B30) in a solvent mixture of 5 liters of toluene is then injected in the course of 20 minutes at room temperature into the wetted mix at ii) above.

iv) The rate of stirring is so controlled that spherical granulate consisting of metal, filler, dry lubricant and solvent is obtained after stirring has been continued for 20 minutes at room temperature.

v) The granulate is separated from the water by suction filtration without mechanical action on the filter product. The filtration proceeds very easily on account of the solvent still present in the granulate. The granulate is subsequently freed from solvent by distillation and dried in a vacuum cabinet at 60° C.

vi) Calandering and Slitting follows using a stainless steel two roll calander. The bulk polymer is passed through up to six times, reducing the nip by 5% on each pass to reduce the sectional thickness and increase density until material with the required sectional dimensions for liner is produced.

The addition of 0.15 kg of plasticizer/wet lubricant: Di-2-ethylhexyl sebacate (dioctyl sebacate—DOS) or di-n-octyl phthalate (DOP), or vegetable oil may be required during the calandering pre-mixing stage.

In the second method which yields approximately 10 kg material, the copper particles having the quantities of different diameters described above for this embodiment are mixed with the dry lubricant and dispersing filler with binder and plasticizer in a high shear mixer apparatus, then the resultant bulk polymer so produced is milled and calendared and slit to the required sectional dimensions for liner.

Specific process steps are now described:

i) Charge the mixer with 0.45 kg polyisobutene (BASF Oppanol B10, B12, B15 or B30) and 0.60 kg filler and dry lubricant mixture (0.45 kg h-BN, FL 1690 or FL1710 dry lubricant and 0.15 kg cyanuric acid, melamine, CD123, CD127 or CD141 dispersion filler) and masticate until the mixture has visually blended. This should take 2 minutes with a maximum frictional heat of 90 degrees Centigrade in the mixer.

ii) Add 8.80 kg of the copper particles with different diameters described above and 0.15 kg of the plasticizer/wet lubricant: Di-2-ethylhexyl sebacate (dioctyl sebacate—DOS) or di-n-octyl phthalate (DOP), or vegetable oil, and mix for a further 20 minutes.

iii) Slugs of material are made from four to five batches, by passing bulk polymer batches through a two roll mill up to four times. The colour of the batches to be mixed together into a slug should be comparable so that no streaking occurs.

iv) Calandering and Slitting follows using a stainless steel two roll calander. The bulk polymer is passed through up to six times, reducing the nip by 5% on each pass to reduce the sectional thickness and increase density until material with the required sectional dimensions for liner is produced.

The casing and the filling material comprise, for example, low density polyethylene, obtainable as Plastazote® from Zotefoams plc, 675 Mitcham Road, Croydon, Surrey CR9 3AL, Great Britain. The casing and/or the filling material may have a density in the range of 15 to 60 kg $m^{-3}$, 25 to 60 kg $m^{-3}$, 35 to 60 kg $m^{-3}$, and may be between 45 to 60 kg $m^{-3}$, 50 to 60 kg $m^{-3}$ or 55 to 60 kg $m^{-3}$ to give more structural support to the charge.

The casing and the filling material may be adhered to each other using for example 3M® Impact Vinyl Adhesive 1099 obtainable from 3M UK PLC, Jackson Street, Manchester M15 4PA UK. The linear shaped charge may be attached to the target object using the same adhesive, namely 3M® Impact Vinyl Adhesive 1099 from 3M UK PLC, Jackson Street, Manchester M15 4PA, UK.

The linear shaped charge may be manufactured by extruding the explosive element and the liner from the appropriate material. The casing and filling material may be manufactured by a suitable cutting or grinding process. The explosive element, liner, casing and filling material may then be assembled to form the charge, including adhering the casing to the filling material.

The above embodiments are to be understood as illustrative examples of the invention. Further embodiments of the invention are envisaged. For example the explosive element, the liner, the casing and the filling material may be formed of different materials from those described above. Further, the configuration of the charge, the liner, explosive element, casing and filling material may be different from those described above and illustrated in the Figures, whilst keeping within the parameters of the linear shaped charge defined in the present invention.

Numerical ranges are given above. Although minimum and maximum values of such ranges are given, each numerical value between the minimum and maximum values, including rational numbers, should be understood to be explicitly disclosed herein. For example, a range of 101.5 to 106.5 degrees also discloses numerical values of for example 101.8, 103.57 and 104.636 degrees.

Further embodiments of the invention are envisaged with different values from those described above of the stand-off distance SD, the distance S, the apex angle $\alpha$, the length L, the thickness E and the thickness T, within the ranges of such values defined in accordance with the present invention. Further, the explosive loading of the explosive element may be different from the examples given above. Also, the explosive element may comprise a material with a greater explosive density; i.e. a material with a greater explosive power/detonation pressure for a given mass than the materials of the explosive element described above. It is to be appreciated that the dimensions described in accordance with the present invention would still apply in such embodiments. Indeed, embodiments in accordance with the present invention are envisaged, using any value of thickness T, or distance S, and may in such embodiments use the relationship of thickness E, length L and thickness T of 5:9:1, and using an appropriate explosive density for the explosive element.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A linear shaped charge comprising:

an explosive element, a face for application to a target object, and a liner arranged for projection towards the face when the explosive element is detonated, the explosive element and the liner having a V-shaped cross section and extending in a direction normal to the V-shaped cross section, the liner lying in a groove of the V-shaped cross section of the explosive element, the liner having a length L of a side furthest from the face and the liner having a thickness T taken perpendicular to said length L as measured in cross section, wherein an angle α of an apex of the liner nearest the face is 101.5 to 106.5 degrees, and a stand-off distance SD between the face and a point of the liner nearest the face is 0.99 S to 1.21 S, S being a distance, parallel the stand-off distance SD, between the point of the liner nearest the face and the apex of the liner nearest the face as measured in cross-section.

2. A linear shaped charge according to claim 1, wherein the apex angle α is at least one of: 102 to 106 degrees, 102.5 to 105.5 degrees or 103 to 105 degrees.

3. A linear shaped charge according to claim 1, wherein the stand-off distance SD is at least one of: 1.045 S to 1.155 S, 1.075 S to 1.125 S, or 1.1 S.

4. A linear shaped charge according to claim 1, wherein S is at least one of: 2.4 to 33.9, 2.4 to 3.0, 2.7, 3.8 to 4.7, 4.3, 7.3 to 9.0, 8.2, 9.6 to 11.8, 10.7, 13.3 to 16.3, 14.8, 21.5 to 26.3, 23.9, 24.8 to 30.3, 27.6, 27.8 to 33.9, or 30.8 milli-meters.

5. A linear shaped charge according to claim 1, wherein the distance SD is at least one of: 2.7 to 37.3, 2.7 to 3.3, 3.0, 4.2 to 5.2, 4.7, 8.1 to 9.9, 9.0, 10.6 to 12.9, 11.8, 14.6 to 17.9, 16.3, 23.7 to 28.9, 26.3, 27.3 to 33.4, 30.3, 30.5 to 37.3 or 33.9 milli-meters.

6. A linear shaped charge according to claim 1, wherein the thickness T is at least one of: 0.4 to 6.1, 0.4 to 0.5, 0.5, 0.7 to 0.9, 0.8, 1.3 to 1.6, 1.5, 1.7 to 2.1, 1.9, 2.4 to 2.9, 2.6, 3.8 to 4.7, 4.3, 4.4 to 5.4, 4.9, 5.0 to 6.1 or 5.5 milli-meters.

7. A linear shaped charge according to claim 1, wherein a length L of a side of the V-shaped liner furthest from the face is at least one of: 8.1 T to 9.9 T, 8.55 T to 9.45 T, or 9 T.

8. A linear shaped charge according to claim 1, wherein a thickness E of the explosive element, as measured in cross section and taken perpendicular to a length of a side of the V-shaped explosive element, is at least one of: 4.5 T to 5.5 T, 4.75 T to 5.25 T, or 5 T.

9. A linear shaped charge according to claim 1, wherein a length L of a side of the V-shaped liner furthest from the face is at least one of: 8.1 T to 9.9 T, 8.55 T to 9.45 T, or 9 T; and a thickness E of the explosive element, as measured in cross section and taken perpendicular a length of a side of the V-shaped explosive element, is at least one of: 4.5 T to 5.5 T, 4.75 T to 5.25 T, or 5 T.

10. A linear shaped charge according to claim 9, wherein the apex angle α is 103 degrees, the stand-off distance is 1.1 S, and with the stand-off distance being 9.0, 11.8 or 16.3 milli-meters, the length L is 13.1, 17.2 or 23.8 milli-meters, respectively, the thickness E is 7.3, 9.5 or 13.2 milli-meters, respectively, and the thickness T is 1.5, 1.9 or 2.6 milli-meters, respectively.

11. A linear shaped charge according to claim 9, wherein the apex angle α is 105 degrees, the stand-off distance is 1.1 S, and with the stand-off distance being 3.0 or 4.7 milli-meters, the length L is 4.4 or 7.0 milli-meters, respectively, the thickness E is 2.5 or 3.9 milli-meters, respectively, and the thickness T is 0.5 or 0.8 milli-meters, respectively.

12. A linear shaped charge according to claim 9, wherein the apex angle α is 103 degrees, the stand-off distance is 1.1 S, and with the stand-off distance SD being 9.0, 11.8 or 16.3 milli-meters, an explosive load of the explosive element is substantially 0.35, 0.6 or 1.15 kg $m^{-1}$, respectively, the length L is 13.1, 17.2 or 23.8 milli-meters, respectively, the thickness E is 7.3, 9.5 or 13.2 milli-meters, respectively, and the thickness T is 1.5, 1.9 or 2.6 milli-meters, respectively.

13. A linear shaped charge according to claim 9, wherein the apex angle α is 105 degrees, the stand-off distance is 1.1 S, and with the stand-off distance SD being 3.0 or 4.7 milli-meters, an explosive load of the explosive element is substantially 0.04 or 0.1 kg $m^{-1}$, respectively, the length L is 4.4 or 7.0 milli-meters, respectively, the thickness E is 2.5 or 3.9 milli-meters, respectively, and the thickness T is 0.5 or 0.8 milli-meters, respectively.

14. A linear shaped charge according to claim 1, wherein the apex angle α is 103 degrees and the stand-off distance SD is at least one of: 9.0, 11.8 or 16.3 milli-meters.

15. A linear shaped charge according to claim 14, wherein, with the stand-off distance SD being 9.0, 11.8 or 16.3 milli-meters, an explosive load of the explosive element is substantially 0.35, 0.6 or 1.15 kg $m^{-1}$, respectively.

16. A linear shaped charge according to claim 1, wherein the apex angle α is 105 degrees and the stand-off distance SD is 3.0 or 4.7 milli-meters.

17. A linear shaped charge according to claim 16, wherein, with the stand-off distance SD being 3.0 or 4.7 milli-meters, an explosive load of the explosive element is substantially 0.04 or 0.1 kg $m^{-1}$, respectively.

18. A linear shaped charge according to claim 1, comprising a casing surrounding at least part of the explosive element, as viewed in cross section.

19. A linear shaped charge according to claim 18, wherein the casing is arranged to determine the stand-off distance SD, the casing having at least one part for application to the target object.

20. A linear shaped charge according to claim 1, wherein the stand-off distance is perpendicular to a plane of the face, and the distance S is perpendicular to the plane of the face, as viewed in cross section.

* * * * *